US005860465A

United States Patent [19]

Eastridge et al.

[11] Patent Number: 5,860,465

[45] Date of Patent: Jan. 19, 1999

[54] COMBINED GARAGE DOOR SCREEN AND GARAGE DOOR AND METHOD

[76] Inventors: Gary L. Eastridge, 537 Close; Howard G. Kirkwood, 851 Coral Cottage Dr., both of Henderson, Nev. 89015

[21] Appl. No.: 911,626

[22] Filed: Aug. 15, 1997

[51] Int. Cl.[6] ..... E06B 3/48

[52] U.S. Cl. ..... 160/113; 160/201

[58] Field of Search ..... 160/113, 117, 160/118, 201, 188, 189, 5, 133, 310, 265, 405

[56] References Cited

U.S. PATENT DOCUMENTS

| | | | |
|---|---|---|---|
| 2,072,092 | 3/1937 | Blodgett | 160/113 |
| 3,021,896 | 2/1962 | Buono et al. | 160/113 |
| 3,044,540 | 7/1962 | Hammersley | 160/201 X |
| 3,103,967 | 9/1963 | Gaschen | 160/113 |
| 3,938,577 | 2/1976 | Richards | 160/113 X |
| 4,231,412 | 11/1980 | Nowak | 160/113 X |
| 4,356,668 | 11/1982 | Wagner | 160/113 X |
| 4,653,566 | 3/1987 | Miale | 160/201 |
| 5,050,660 | 9/1991 | Bleichwehl et al. | 160/201 X |
| 5,408,789 | 4/1995 | Plfeger | 160/113 X |
| 5,611,382 | 3/1997 | Sferra | 160/201 X |

*Primary Examiner*—David M. Purol
*Attorney, Agent, or Firm*—Harry M. Weiss; Jeffrey D. Moy; Harry M. Weiss & Associates, P.C.

[57] ABSTRACT

A combined garage door screen and garage door and method is disclosed wherein the garage door screen can be selectively fixedly attached to the back of the garage door in either a lower (closed screen) position when the bottom portion of the garage door is spaced from the ground or an upper (screen up) position when the bottom portion of the garage door screen is raised to a level at least equal to the level of the bottom portion of the garage door.

6 Claims, 3 Drawing Sheets

COMBINED GARAGE DOOR SCREEN AND GARAGE DOOR AND METHOD

FILED OF THE INVENTION

This invention relates generally to garage doors and garage door screens connected thereto and methods therefor and, more particularly, to an improved combination garage door screen and garage door and method wherein the garage door screen can be reliably locked against movement when the garage door screen is in its lowermost (closed) position and the garage door screen can also be releasably locked against movement when the garage door screen is elevated to permit a bottom portion thereof to be at a corresponding parallel level with a bottom portion of the garage door.

BACKGROUND OF THE PRIOR ART

In the past, people have recognized the desirability of having garage doors partially opened in order to provide introduction of fresh outside air within the garage area. However, unless a person is in the garage area, leaving a garage door partially open provides a risk of permitting a thief to gain access to the garage area where bicycles, tools, etc. may be located. Even if a person was in the garage area, leaving a garage door partially open is an invitation to permit animals and insects to penetrate into the garage area through the partial opening created by the garage door being partially open.

As a result, people have sought to block the opening created by the garage door being partially open with a screen which prevented an entry by insects and animals. For example, U.S. Pat. No. 5,427,169 disclosed a garage door screen which contained a passageway provided by a pair of zippers. However, the garage door screen was not attached to a garage door, but served only to cover the garage door opening. U.S. Pat. No. 5,271,449 is similar to U.S. Pat. No. 5,427,169, but discloses a different form of attachment. U.S. Pat. No. 4,653,566 discloses top and bottom screens for a garage door, however, the bottom screen can only be attached to the garage door either when the bottom screen is in its upper (elevated position) with the garage door open or when the garage door is lowered to its lowest (at ground) position with the screen also at its lowest (ground) position. However, there is no provision for locking the screen to the garage door when the screen is in its lowest position and the garage door is open. Thus, a potential thief or burglar can lift the bottom screen, when the garage door has been lifted, to an elevated level above ground or where the bottom portion of the bottom screen is at the same level as the bottom portion of the garage door. U.S. Design Pat. No. 357,071 discloses a garage door drop screen similar to the screens disclosed in U.S. Pat. Nos. 5,427,169 and 5,271,449.

Currently, electrically controlled garage doors that are operated by remote controlled devices for opening and closing these garage doors are required to provide a sensing system located adjacent the bottom portion of the garage door opening which is used to detect if a person, animal or object is located adjacent the bottom portion of the garage door opening and function to prevent the electrically controlled garage door to strike such a person, animal or object when moving towards a closed position. Thus, using a bottom screen on an inside portion of a garage door created a problem because the garage door and attached bottom screen were not sensed by the sensing system and, therefore, they were both lowered together and the electrically controlled garage door continued to its closed position. Consequently, the bottom screen could not, in the past, be fixedly attached to the garage door to extend below the bottom portion thereof because the garage door moving to its bottom closed position would crush or severely damage the attached (lower positioned) bottom screen.

Accordingly, a need existed to provide a combined garage door screen and garage door and method which permitted a garage door screen or bottom screen to be attached to the inside portion of the garage door and to be movable relative to the garage door to be selectively locked both into an upper position where the bottom portion of the bottom screen does not extend below the bottom portion of the garage door and into a lower position where the bottom portion of the bottom screen closes the opening located between the bottom portion of the garage door spaced from the ground.

SUMMARY OF THE INVENTION

Accordingly, it is an object of this invention to provide an improved combined garage door screen and garage door and method.

It is another object of this invention to provide an improved combined garage door screen and garage door and method wherein the garage door screen can selectively be fixedly attached to the garage door in two different positions.

It is a further object of this invention to provide an improved combined garage door screen and garage door and method wherein the garage door screen can be fixedly attached to the garage door in a lower (closed screen) position when the bottom of the garage door is spaced from the ground.

It is a still further object of this invention to provide an improved combined garage door screen and garage door and method wherein the garage door screen can be selectively fixedly attached to the garage door in either a lower (closed screen or screen down) position when the bottom portion of the garage door is spaced from the ground or an upper (screen up) position when the bottom portion of the garage door screen is raised to a level at least equal to the level of the bottom portion of the garage door.

BRIEF DESCRIPTION OF THE PREFERRED EMBODIMENTS

In accordance with one embodiment of this invention, a combination garage door screen and garage door comprises, in combination: a garage door; a garage door screen coupled to a rear portion of the garage door; and locking means coupled to both the rear portion of the garage door and the garage door screen for permitting a bottom portion of the garage door screen to be lowered and locked in a first locking position substantially parallel to and equivalent to a closed position of the garage door when the garage door is raised to a position spaced from the closed position.

In accordance with another embodiment of this invention, a method is disclosed of operating a garage door screen relative to a garage door associated therewith which comprises the steps of: providing a garage door; coupling a garage door screen to a rear portion of the garage door; and providing locking means coupled to both the rear portion of the garage door and the garage door screen for permitting a bottom portion of the garage door screen to be lowered and locked in a first locking position substantially parallel to and equivalent to a closed position of the garage door when the garage door is raised to a position spaced from the closed position.

The foregoing and other objects, features and advantages of this invention will be apparent from the following more particular description of the preferred embodiments of the invention as illustrated in the accompanying drawings.

DESCRIPTION OF THE SPECIFICATION

Figure 1:
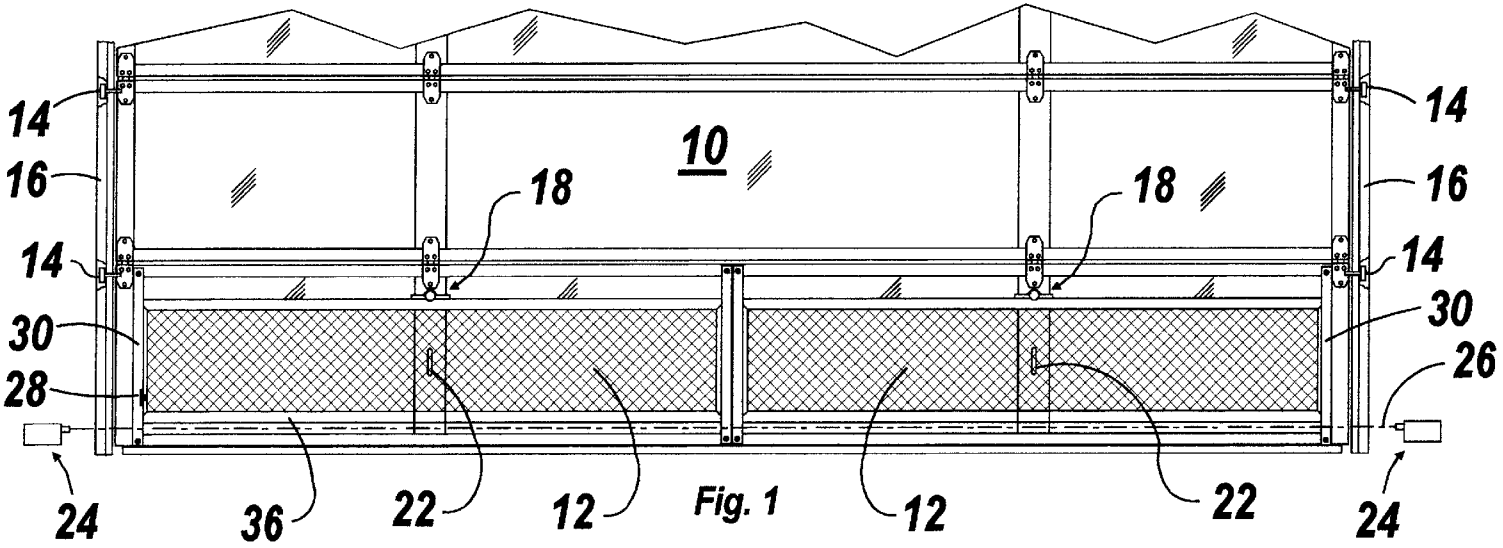
FIG. 1 is a rear side elevational view showing a garage door (bottom) screen located on an inside portion of a garage door and fixedly attached thereto at a position where the bottom portion of the garage door screen is above the bottom portion of the garage door when the garage door is in its closed position.
Figure 2:
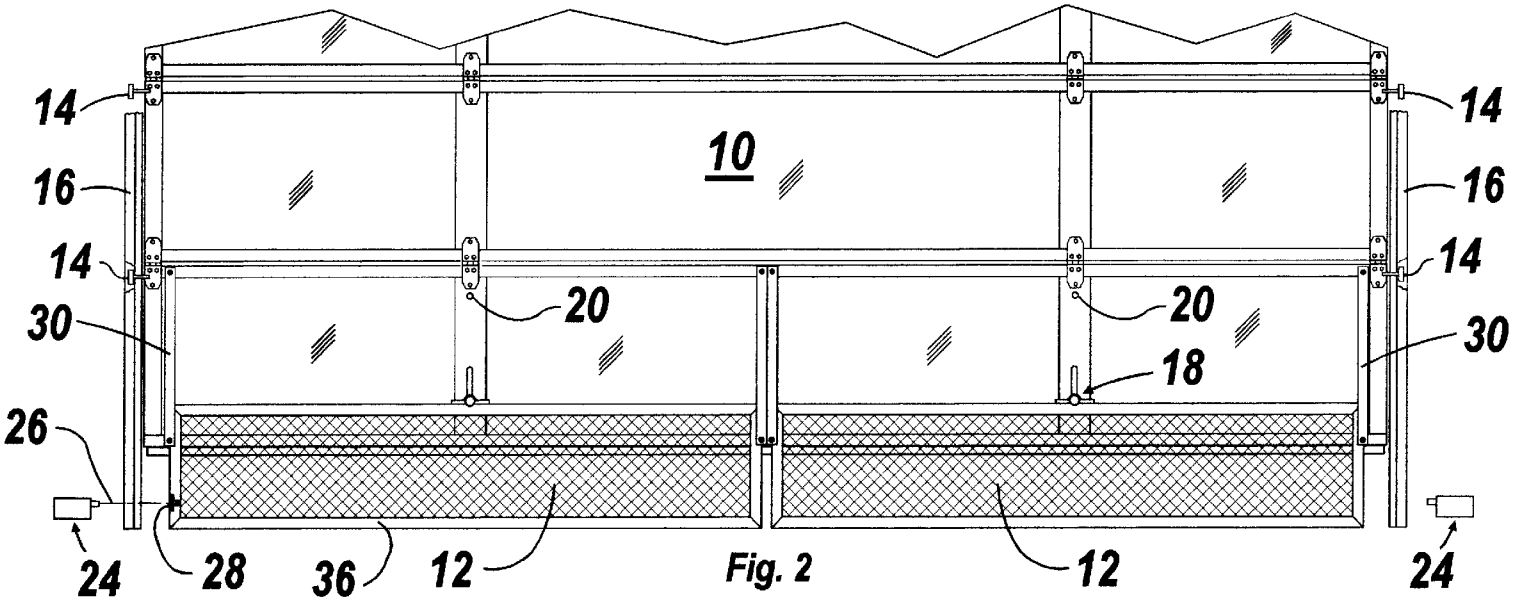
FIG. 2 is a view similar to FIG. 1 but shows the garage door (bottom) screen fixedly attached to the garage door where the bottom portion of the garage door screen is lower than the bottom portion of the garage door to close the space between the bottom portion of the garage door and the ground.

Referring to FIGS. 1 and 2, reference numeral 10 designates a garage door located within an opening for the garage door 10. A garage screen door 12 is positioned for vertical movement relative to the garage door 10 and is coupled thereto on the inside thereof. In the embodiment of FIGS. 1 and 2, two separate garage door screens 12 are shown, however, one long screen can be used, if desired. A plurality of wheel or roller type members 14 attached to the garage door 10 at the two edges thereof serve to permit the garage door 10 to be raised and lowered, as desired, since the wheel or roller type members 14 roll within tracks 16 that are attached to a house or building (not shown). The garage door lo is preferably comprised of a plurality of sections that are internally hinged to permit the garage door 10 to be raised and lowered whereby each of the sections of the garage door 10 can be pivoted somewhat with respect to adjacent sections because of the hinges.

As can be seen with reference to FIGS. 1 and 2, FIG. 1 depicts the garage door 10 in its lowest position with its bottom portion near the ground. In this down or closed position, the bottom portion of the garage door 10 and the bottom portion of the garage door screen 12 are at the same level because the garage door screen 12 is fixedly attached to the garage door 10 at its highest level by means of a looking arrangement 18 attached to and movable with a top portion of the garage door screen 12 that preferably engages (first engagement means) an upper opening 20 (see FIG. 2) on the back or inner portion of the garage door 10.

With specific reference to FIG. 2, this Figure depicts the garage door screen 12 in its down or closed position with its bottom portion close to ground. In this closed position, the garage door 10 is raised, as shown in FIG. 2, so that the bottom portion of the garage door 10 is spaced from the ground. This permits the garage door screen 12 to function to screen out insects, animals and any possible human intruders with the garage door 10 open to provide ventilation for the garage area behind or inside the garage door 10. The garage door screen 12 is fixedly attached to the garage door 10 in this closed position as shown in FIG. 2. This is achieved because the locking arrangement 18 on the garage door screen 12 engages (second engagement means) lower opening 22 (see FIG. 1) at the rear of the garage door 10. Since the garage door screen 12 is fixedly attached to the garage door 10, as shown in FIG. 2, a potential burglar or thief cannot lift the garage door screen 12.

Figure 3:
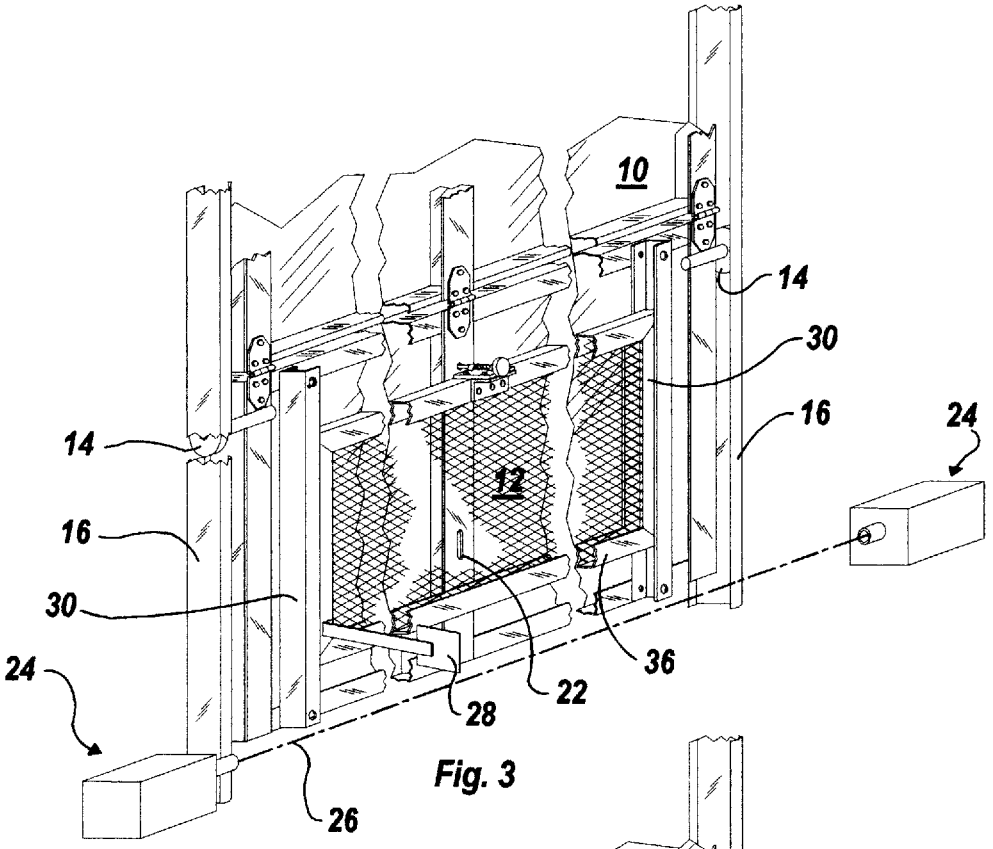
FIG. 3 is an enlarged rear perspective view of the combined garage door screen and garage door as shown in FIG. 1.
Figure 4:
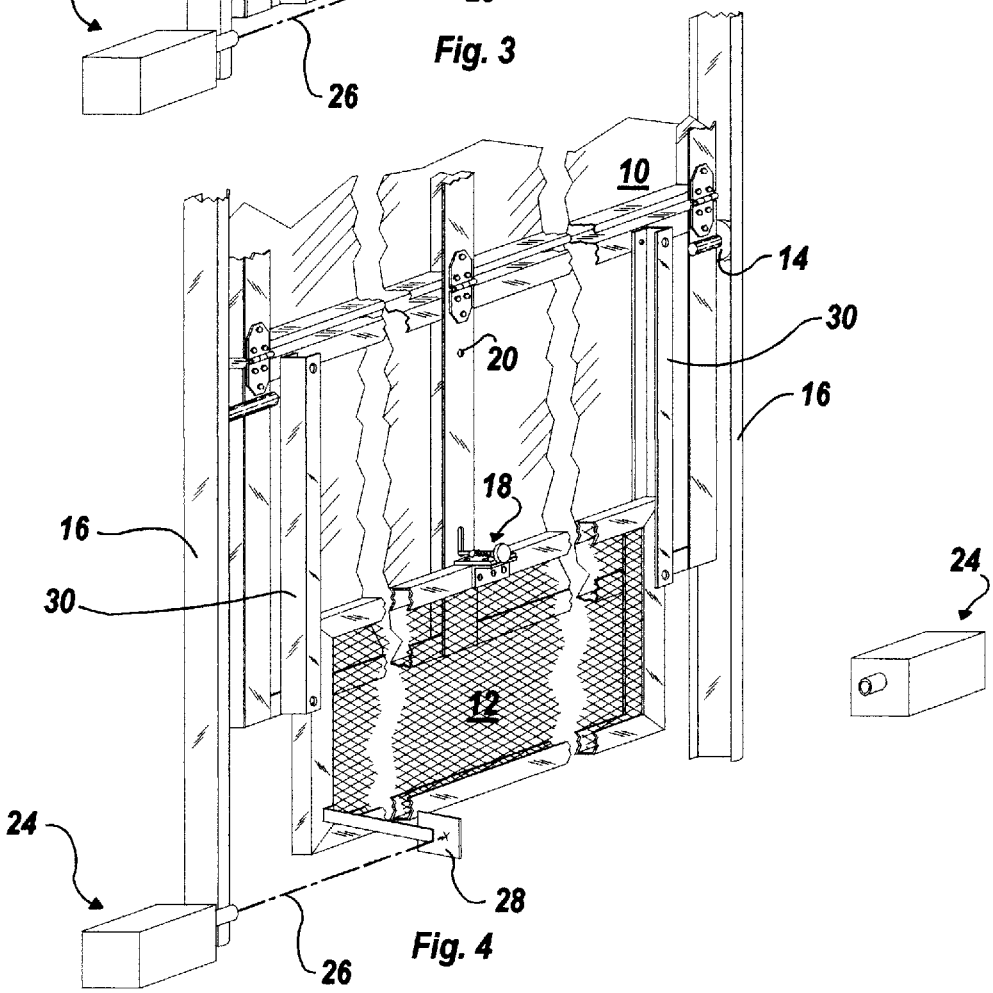
FIG. 4 is an enlarged rear perspective view of the combined garage door screen and garage door as shown in FIG. 2.

With reference to FIGS. 3 and 4 which are enlarged perspective views (with parts broken away) of FIGS. 1 and 2, respectively, the garage door 10 is shown in a closed position with the garage door screen 12 raised to its upper fixed position spaced from the ground (see FIG. 3) whereas, in FIG. 4, the garage door 10 is shown raised to permit the garage door screen 12 to be lowered to its lower or lowest fixed position and thereby to permit circulation of air through the garage door screen 12.

A light or beam sensing system 24 (see FIGS. 1, 2, 3 and 4) is provided preferably on the inside of the garage area closely adjacent to the garage door screen 12. With reference to FIGS. 1 and 3, a beam 26 (such as a beam of light) transmitted from one end of the light or beam sensing system 24 is received by the other end of the light or beam sensing system 24 when the garage door screen 12 is raised above ground level (to its upper position as shown in FIGS. 1 and 3). However, in order to keep the garage door 10 in its spaced above ground position as shown in FIGS. 2 and 4, a beam blocking member or means 28 is attached at the bottom portion of the garage door screen 12 on the inside portion thereof. The beam blocking member 28 is used, as shown in FIGS. 2 and 4, to prevent the beam 26 to be transmitted from the left side beam transmission portion of the system 24 to the right side beam receiving or beam sensing portion of the system 24. In this beam blocking position as depicted in FIGS. 2 and 4, the garage door 10 cannot be moved (either up or down) and is fixed in the position shown in FIGS. 2 and 4 with its bottom portion spaced above the ground and the garage door screen 12 is in its closed (fixed lowest) position. Accordingly, raising the garage door screen 12 to its raised (upper fixed) position as shown in FIGS. 1 and 3, permits the beam 26 to be sensed by the system 24 to thereby permit the garage door 10 to now be raised or lowered (remotely or by a direct electrical connection to the electrical controls for the garage door 10).

Figure 5:
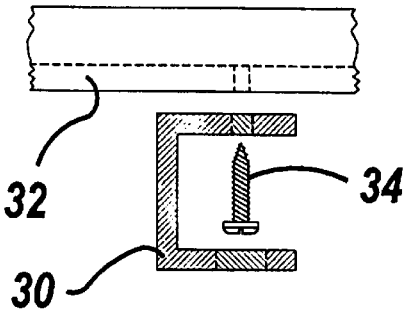
FIG. 5 is an enlarged top view of how the garage door screen is slideably and vertically movably in a U-shaped channel which is attached to a portion of the garage door at a rear portion thereof.
Figure 6:
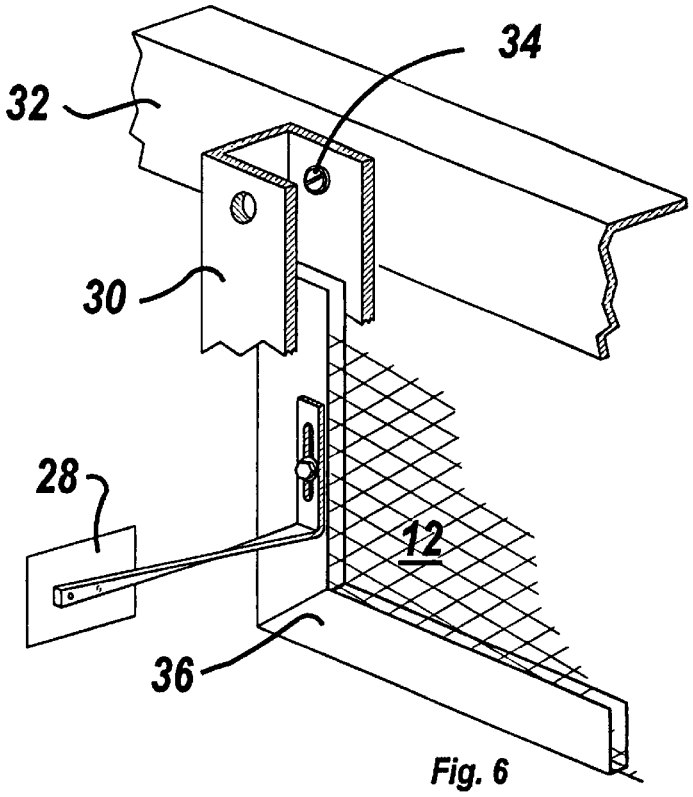
FIG. 6 is an enlarged rear perspective partial view showing the connection of the garage door screen to the back (or inside) of a garage door using the connection arrangement shown in FIG. 5.

Referring to FIGS. 5 and 6, the mechanical connection is shown for connecting U-shaped channel 30 to garage door frame portion 32 by means of a, for example, sheetmetal screw 34. A side portion of frame 36 of the garage door screen 12 is slidable and vertically moveable inside the U-shaped channel 30. The other U-shaped channel for the other side portion of the frame 36 is not shown in FIG. 6, but is shown in FIGS. 1, 2, 3 and 4.

Figure 7:
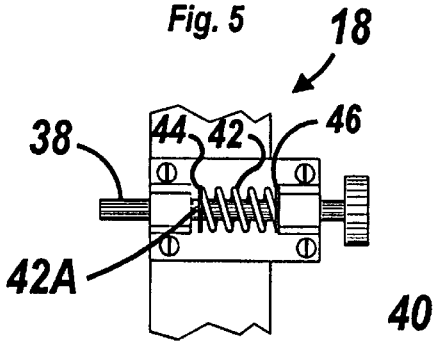
FIG. 7 is an enlarged top view showing the locking pin arrangement in its locked position for locking the garage door screen to the garage door in either an upper or lower locking position.
Figure 8:
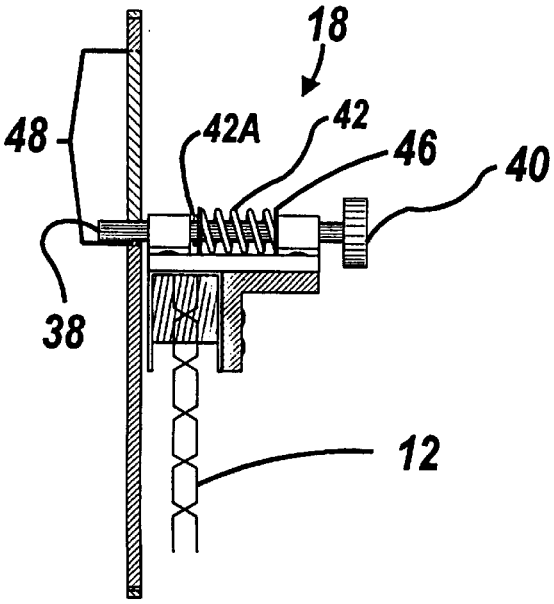
FIG. 8 is an enlarged side elevational view showing the locking pin arrangement of FIG. 7.
Figure 9:
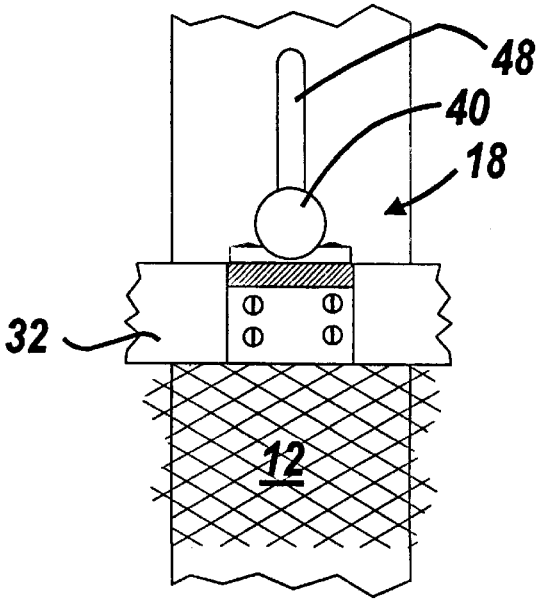
FIG. 9 is an enlarged rear side elevational view showing the locking pin arrangement fixedly coupling the garage door screen to the garage door at the lowest position of the garage door screen.

Referring to FIGS. 7, 8 and 9, enlarged views are shown of the locking arrangement 18 of the garage door screen 12 that is used to selectively engage lower opening 20 or the upper opening 22 on the back (or inside) of the garage door 10 (see FIGS. 1, 2, 3 and 4). The locking arrangement 18 comprises horizontally movable locking pin 38 attached to a knob 40. Spring 42 coiled about a substantially center portion of the pin 38 functions to provide an outward bias on the pin 38 when the knob 40 is pulled backward for removal of the end of the pin 38 from fixed engagement of the locking pin 38 in either the lower (fixed) opening 20 or the higher (fixed) opening 22 of the garage door 10. A small pin 42A is used to engage the back of washer 44 so that pulling the knob 40 (to the right in the position of the knob 40 shown in FIGS. 7 and 8) causes the washer 44 to compress the spring 42 in the direction of washer 46 thereby permitting the locking pin 38 to be pulled out of engagement with either the (lower) opening 20 or the (upper) opening 22. FIG. 9 depicts a (lower) screen locking slot 48 (rather than opening 20) that is used in order to permit a small amount of movement of the garage door screen 12 in an upward vertical direction until the locking pin 38 hits the upper portion of the locking slot 48. This provides a small amount of controlled vertical (upward) movement of the garage door screen 12, if needed.

While the invention has been particularly shown and described with reference to the preferred embodiments thereof, it will be understood by those skilled in the art that the foregoing and other changes in form and details may be made therein without departing from the spirit and scope of the invention.

What is claimed is:

1. A combination garage door screen and garage door comprising, in combination:

a garage door;

a garage door screen coupled to a rear position of said garage door;

locking means coupled to both said rear portion of said garage door and said garage door screen for permitting a bottom portion of said garage door screen to be lowered and locked in a first locking position substantially parallel to and equivalent to a closed position of said garage door when said garage door is raised to a position spaced from said closed position;

first engagement means located on said rear portion of said garage door and part of said locking means for enabling said garage door screen to be located in said first locking position; and second engagement means located on said rear portion of said garage door and part of said locking means for enabling vertical elevation of said garage door screen to be locked in a second locking position where said bottom portion of said garage door screen is not below a bottom portion of said garage door to permit said garage door to be lowered to said closed position.

2. The combination garage door screen and garage door of claim 1 including means located adjacent to said bottom portion of said garage door screen for preventing transmission of a safety light beam across a lower portion of an opening created when said garage door is in an open position to thereby permit said garage door screen to remain in place in a screen closed position and said garage door to remain in place in said open position spaced from said closed position.

3. The combination garage door screen and garage door of claim 1 wherein said first engagement means comprising a first aperture in said rear portion of said garage door, said second engagement means comprising a second aperture in said rear portion of said garage door spaced from said first aperture, said locking means comprising a member selectively insertable in one of said first aperture and said second aperture as desired.

4. A method of operating a garage door screen relative to a garage door associated therewith comprising the steps of:

providing a garage door;

coupling a garage door screen to a rear portion of said garage door;

providing locking means coupled to both said rear portion of said garage door and said garage door screen for permitting a bottom portion of said garage door screen to be lowered and locked in a first locking position substantially parallel to and equivalent to a closed position of said garage door when said garage door is raised to a position spaced from said closed position;

providing first engagement means located on said rear portion of said garage door and part of said locking means for enabling said garage door screen to be located in said first locking position; and providing second engagement means located on said rear portion of said garage door and part of said locking means for enabling vertical elevation of said garage door screen to be locked in a second locking position where said bottom portion of said garage door screen is not below a bottom portion of said garage door to permit said garage door to be lowered to said closed position.

5. The method of claim 4 including means located adjacent to said bottom portion of said garage door screen for preventing transmission of a safety light beam across a lower portion of an opening created when said garage door is in an open position to thereby permit said garage door screen to remain in place in a screen closed position and said garage door to remain in place in said open position spaced from said closed position.

6. The method of claim 4 wherein said first engagement means comprising a first aperture in said rear portion of said garage door, said second engagement means comprising a second aperture in said rear portion of said garage door spaced from said first aperture, said locking means comprising a member selectively insertable in one of said first aperture and said second aperture as desired.

* * * * *